United States Patent [19]

Gomolak

[11] 4,117,615

[45] Oct. 3, 1978

[54] VIEWING PANEL FOR PRODUCING MULTIPLE IMAGES OF A DESIGN

[75] Inventor: Theodore M. Gomolak, Kalamazoo, Mich.

[73] Assignee: Johnstons & Associates, Inc., Kalamazoo, Mich.

[21] Appl. No.: 767,471

[22] Filed: Feb. 10, 1977

[51] Int. Cl.[2] ..... G09F 11/00

[52] U.S. Cl. ..... 40/363; 40/445; 40/454; 40/491

[58] Field of Search ..... 40/63 A, 64 A, 64 R, 40/137, 106.51, 160, 152, 363, 491, 454, 445; 350/167, 211, 162 ZP; 272/8 R, 8 M, 8 D

[56] References Cited

U.S. PATENT DOCUMENTS

| | | | |
|---|---|---|---|
| 2,162,025 | 6/1939 | McClaughry | 40/64 R X |
| 2,577,320 | 12/1951 | Fenyo | 40/160 X |
| 3,079,959 | 3/1963 | Johnston | 40/64 A X |
| 3,661,385 | 5/1972 | Schneider | 40/106.51 X |

*Primary Examiner*—John F. Pitrelli
*Assistant Examiner*—G. Lee Skillington
*Attorney, Agent, or Firm*—Austin A. Webb

[57] ABSTRACT

A supporting frame with a handle has a transparent supporting plate mounted therein. The plate supports a thin transparency over the exposed surface of the plate. The transparency has a multiplicity of demagnifying fresnel lenses formed therein in abutting relation and in vertical and horizontal rows. The lens areas are rectangular in outline with very fine and closely spaced concentric light refracting grooves formed in one surface of the transparency and extending to the edges of the several areas. The frame has retaining shoulders therearound for removably holding one of several different opaque silhouette cards of different household furnishing articles, which are provided, along one edge of the frame.

3 Claims, 4 Drawing Figures

VIEWING PANEL FOR PRODUCING MULTIPLE IMAGES OF A DESIGN

OUTLINE OF INVENTION

The viewing panel of the invention is designed, primarily, for producing multiple side by side and end to end images of a single design on a sample of wallpaper at a reduced size behind a silhouette of the type of furniture with which the sample paper is being contemplated for use. Adjacent rows and columns of demagnifying or miniaturizing lenses in the panel produce a series of images of the design of the wallpaper (or other design surface) as the design will appear in multiple at approximately the same scale as the articles of furniture represented by the silhouette. The panel may be used to similarly create multiple images of any design to evaluate the desirability of reproducing the original design in full sized multiples.

DRAWINGS AND DESCRIPTION

The drawings, of which there is one sheet, illustrate a preferred form of the viewing panel and the method of its use.

Figure 1:
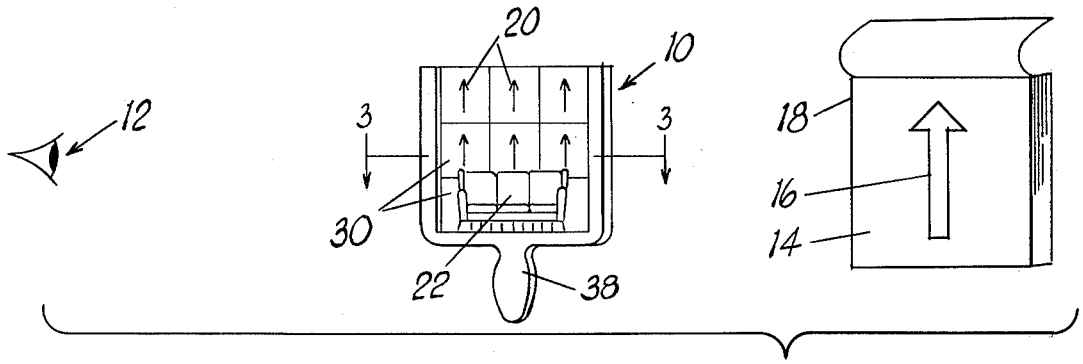
FIG. 1 is a perspective view of the panel in operative relation to a sample design.
Figure 2:
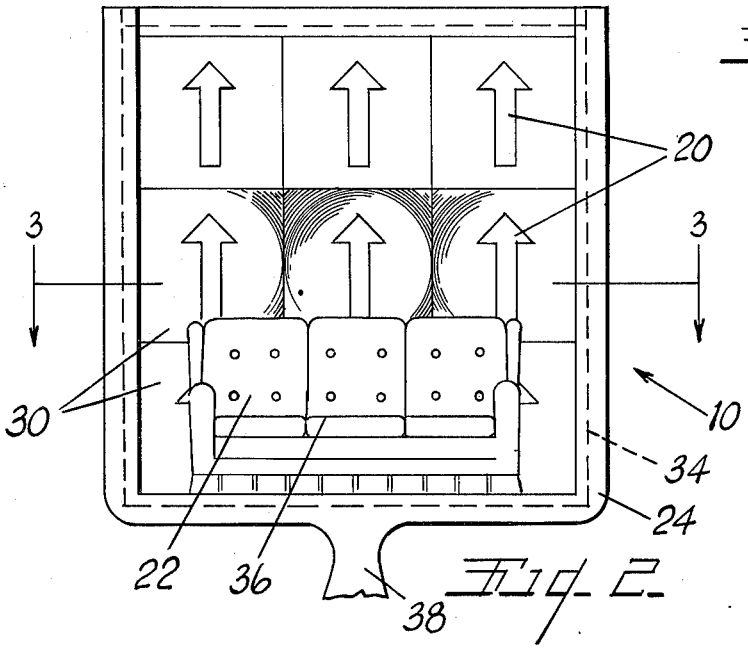
FIG. 2 is an enlarged front plan view of the panel with a silhouette card or panel removably retained therein.
Figure 3:
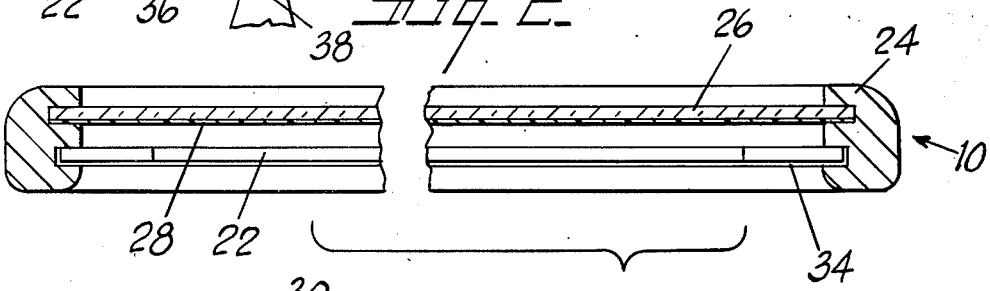
FIG. 3 is a fragmentary and further enlarged cross sectional view along the plane of lines 3—3 in FIGS. 1 and 2.
Figure 4:
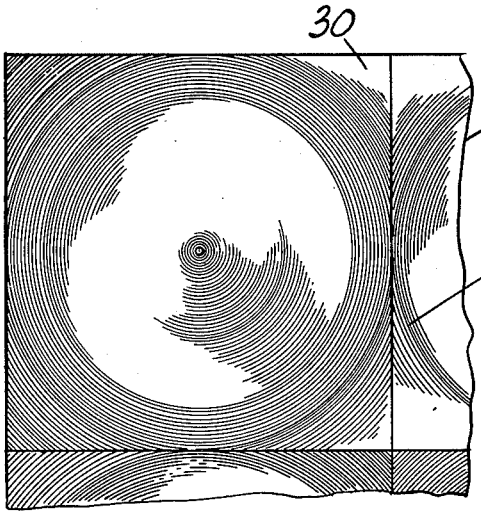
FIG. 4 is an enlarged elevational view of one of the lens areas of the viewing panel.

In FIG. 1 the viewing panel 10 is shown in use for its designed purpose by a viewer indicated by the eye 12 to obtain a view and form an opinion of how the design of a wallpaper sample 14 will appear when a wall is covered by multiple strips of the paper. For ease in illustration the design is indicated by the arrow 16. The sample is likely to be one of many bound in a sample book 18. As shown, the viewing panel produces multiple images 20 of the sample design, and for more complete assessment of the appearance of the design, a silhouette panel 22 removably supported adjacent to the viewing panel shows how the design will appear behind a given type of furniture such as the davenport shown. Silhouettes of different pieces of furniture will normally be provided for interchangeable use with the panel.

As is more clearly shown in the other figures, the viewing panel 10 includes a suitable support in the form of a rectangular frame 24 which has a transparent plate 26 of glass or clear plastic permanently retained therein.

Lapped upon the plate is a thin transparent lens sheet 28 which is conveniently made of clear plastic. The lens sheet has nine demagnifying lens areas 30 known as fresnel lenses formed thereon. Each lens area consists of a series of very closely spaced circular or spiral diffracting grooves 32 which are concentrically centered in each lens area and which extend to a line or lines of demarcation between the grooves in adjacent areas. Each lens produces its own image 20, so the number and size of the areas 30 determines the number of images on the viewer panel. The lens area and its grooves per se is an item available on the market so is not described in greater detail. The grooves may be pressed into the surface of the sheet 28 by a groove die or dies.

The frame 24 defines a U-shaped slot 34 along the sides and bottom of the view opening to removably receive and hold the different silhouette panels 22. The silhouettes are lightly lined with major features of the item of furniture shown as at 36, but no attempt is made to illustrate any special or particular article in detail as that would detract from the over-all image of the multiple patterns. A handle 38 is desirably provided on the frame.

What is claimed as new is:

1. A viewing panel for viewing various designs as a background for various pieces of furniture comprising:

a frame having a transparent lens sheet supported in planar relation therein, said sheet having a plurality of fresnel lenses formed therein in adjacent horizontal and vertical rows, a plurality of silhouette cards having at least one dimension shorter than the corresponding dimension of said frame and sheet and representing the shapes of various articles of furniture, means on said frame for selectively and removably holding one of said cards in overlapped relation over a portion of said sheet, and a handle on said frame, whereby a person holding said frame in spaced relation between his eyes and a portion of a repeating design such as sample of wall paper will see images of the design reproduced in horizontal rows behind one of the silhouette cards.

2. A viewing panel as defined in claim 1 in which said lenses on said sheet extend to common borders and narrow lines of demarcation disposed as a grid on said sheet.

3. A viewing panel as defined in claim 2 in which said means for holding said cards consists of opposed parallel slots in opposite sides of said frame and open at one end and closed at the other and adapted to receive the side edges of one of said cards.

* * * * *